US011458739B2

(12) United States Patent
Nakatani

(10) Patent No.: US 11,458,739 B2
(45) Date of Patent: Oct. 4, 2022

(54) THERMAL PRINT HEAD, MANUFACTURING METHOD OF THERMAL PRINT HEAD, AND THERMAL PRINTER

(71) Applicant: ROHM Co., Ltd., Kyoto (JP)

(72) Inventor: Goro Nakatani, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 17/239,260

(22) Filed: Apr. 23, 2021

(65) Prior Publication Data

US 2021/0331487 A1 Oct. 28, 2021

(30) Foreign Application Priority Data

Apr. 27, 2020 (JP) ..... JP2020-078279

(51) Int. Cl.
*B41J 2/335* (2006.01)
*B41J 2/32* (2006.01)

(52) U.S. Cl.
CPC ..... *B41J 2/3353* (2013.01); *B41J 2/3352* (2013.01); *B41J 2/3359* (2013.01); *B41J 2/33505* (2013.01); *B41J 2/32* (2013.01)

(58) Field of Classification Search
CPC . B41J 2/3353; B41J 2/3352; B41J 2/32; B41J 2/33505; B41J 2/3359
See application file for complete search history.

(56) References Cited

U.S. PATENT DOCUMENTS

2004/0212669 A1* 10/2004 Shirakawa ..... B41J 2/33525 347/200
2017/0182794 A1* 6/2017 Nishimura ..... B41J 2/3357
2020/0101761 A1* 4/2020 Kumagai ..... B41J 2/3353

FOREIGN PATENT DOCUMENTS

JP 2018034407 A 3/2018

* cited by examiner

*Primary Examiner* — Yaovi M Ameh
(74) *Attorney, Agent, or Firm* — Hamre, Schumann, Mueller & Larson, P.C.

(57) ABSTRACT

The present disclosure provides a thermal print head and a method manufacturing thereof and a thermal printer including the thermal print head, which are capable of suppressing low manufacturing efficiency and enhancing wear-resistance against a recording medium. The thermal print head includes: a substrate, having a main surface facing a thickness direction; a resistance layer, including multiple heating portions arranged in a main scan direction and formed on the main surface; a wiring layer, formed on the resistance layer and connected to the heating portions; and a protection layer, covering a part of the main surface, the heating portions and the wiring layer.

19 Claims, 12 Drawing Sheets

THERMAL PRINT HEAD, MANUFACTURING METHOD OF THERMAL PRINT HEAD, AND THERMAL PRINTER

BACKGROUND OF THE INVENTION

Field of the Invention

The disclosure relates to a thermal print head and a manufacturing method thereof and a thermal printer including the thermal print head.

Description of the Prior Art

Patent document 1 discloses an example of a thermal print head. The thermal print head includes a heating resistor arranged on a support substrate, and multiple electrodes provided at the heating resistor. The heating resistor generates heat when a current flows in the multiple electrodes. Accordingly, printing is performed on a recording medium such as thermal paper.

The thermal print head further includes a protection film covering the heating resistor and the multiple electrodes. The protection film has a characteristic of different levels of distribution regarding film stress acting on the inside of the protection film in the thickness direction of the support substrate. Specifically with respect to the distribution of the film stress, the film stress gradually increases as getting farther away from the heating resistance in the thickness direction. Thus, in response to the increased hardness of the surface of the protection film, the wear-resistance of the thermal print head against the recording medium becomes even more outstanding. Moreover, in the thickness direction, as the film stress acting on the inside of the protection film gradually decreases from the surface of the protection film to the heating resistor, the thermal stress concentration caused by heating of the heating resistor is suppressed. Thus, even if the hardness of the protection film is large, cracking of the protection film is less likely to occur.

However, the protection film is formed by means of sputtering. When the protection film is formed, air pressure needs to be adjusted each time the film is formed, and film formation needs to be performed for a large number of times in order to deposit silicon films. Thus, the formation of the protection film is a critical reason causing low manufacturing efficiency of the thermal print head, and so it is expected that improvement be made accordingly.

PRIOR ART DOCUMENT

Patent Publication

[Patent document 1] Japan Patent Publication No. 2018-34407

SUMMARY

Problems to be Solved by the Invention

In view of the issues above, a task of the disclosure is to provide a thermal print head and a manufacturing method thereof and a thermal printer including the thermal print head, which are capable of suppressing low manufacturing efficiency and enhancing wear-resistance against a recording medium.

Technical Means for Solving the Problem

A thermal print head according to the first embodiment of the disclosure includes: a substrate, having a main surface facing a thickness direction; a resistance layer, including multiple heating portions arranged in a main scan direction and formed on the main surface; a wiring layer, formed on the resistance layer and connected to the multiple heating portions; and a protection layer, covering a part of the main surface, the multiple heating portions and the wiring layer. The thermal print head further includes: a coating layer, covering at least a part of the protection layer. The coating layer overlaps with the multiple heating portions when observed along the thickness direction, and includes a base layer connected to the protection layer, and a body layer overlaying the base layer, wherein the base layer and the body layer include metal elements, respectively.

In a preferred embodiment of the disclosure, the metal elements are bonded to each other by a metal bond.

In a preferred embodiment of the disclosure, a Vickers hardness of the body layer is more than a Vickers hardness of the protection layer.

In a preferred embodiment of the disclosure, the protection layer includes silicon.

In a preferred embodiment of the disclosure, the main surface includes a base surface and a protruding surface protruding from the base surface in the thickness direction. The protruding surface extends along the main scan direction, and the multiple heating portions are formed on the protruding surface.

In a preferred embodiment of the disclosure, the coating layer overlaps with the protruding surface when observed along the thickness direction.

In a preferred embodiment of the disclosure, the protruding surface includes: a top surface, parallel to the base surface; and a pair of inclined surfaces, connected to the top surface and the base surface, and located on positions separated from each other in a secondary scan direction. The multiple heating portions are formed on at least one of the top surface and the pair of inclined surfaces.

In a preferred embodiment of the disclosure, the wiring layer includes a common wire and multiple independent wires. The common wire is formed on one side of the secondary scan direction relative to the multiple heating portions, and the multiple independent wires are formed on the other side of the secondary scan direction relative to the multiple heating portions. A part of the common wire and a part of each of the multiple independent wires are formed on any one of the pair of inclined surfaces.

In a preferred embodiment of the disclosure, the pair of inclined surfaces are inclined relative to the base surface in a way of approaching each other from the base surface toward the top surface.

In a preferred embodiment of the disclosure, each of the pair of inclined surfaces includes a first region connected to the base surface, and a second region connected to the top surface and the first region. An inclined angle of the second region relative to the base surface is less than an inclined angle of the first region relative to the base surface.

In a preferred embodiment of the disclosure, the substrate includes a semiconductor material, and the semiconductor material comprises a monocrystalline material consisting of silicon.

In a preferred embodiment of the disclosure, an insulation layer covering the main surface is further included. The resistance layer is connected to the insulation layer.

In a preferred embodiment of the disclosure, a heat dissipation plate is further included, the substrate has a back surface on one side opposite to the main surface in the thickness direction, and the back surface is joined with the heat dissipation plate.

A manufacturing method of a thermal print head according to a second embodiment of the disclosure is characterized in including the following steps: forming a resistance layer on a main surface, the resistance layer including multiple heating portions arranged in a main scan direction relative to a base material having a main surface facing a thickness direction; forming a wiring layer connected to the multiple heating portions on the resistance layer; forming a protection layer covering a part of the main surface, the multiple heating portions and the wiring layer. The manufacturing method further includes steps of: after the step of forming the protection layer, a step of forming a coating layer covering at least a part of the protection layer; the step of forming the coating layer includes: a step of forming a base layer, the base layer being connected to the protection layer and including a metal element, and a step of forming a body layer, the body layer overlaying the base layer and including the metal element, wherein the body layer is formed by means of plating.

In a preferred embodiment of the disclosure, in the step of forming the coating layer, the base layer is formed by means of sputtering, and in the step of forming the coating layer, the body layer is formed by means of electroplating using the base layer as a conductive path.

In a preferred embodiment of the disclosure, the main surface includes a base surface and a protruding surface protruding from the base surface in the thickness direction; before the step of forming the resistance layer, the method further includes a step of forming a protrusion on the base material, wherein the protrusion protrudes from the base surface in the thickness direction, extends along the main scan direction, and includes the protruding surface; and in the step of forming the resistance layer, the multiple heating portions are formed on the protruding surface.

In a preferred embodiment of the disclosure, the base material includes a semiconductor material, and the semiconductor material includes a monocrystalline material consisting of silicon.

In a preferred embodiment of the disclosure, in the step of forming the protrusion, the protrusion is formed by means of anisotropic etching.

A thermal printer provided according to a third embodiment of the disclosure includes: the thermal print head provided according to the first embodiment of the disclosure; and a pressure plate, arranged oppositely to the multiple heating portions.

Effects of the Invention

According to the thermal print head and the manufacturing method thereof, low manufacturing efficiency can be suppressed, and wear-resistance against a recording medium can be enhanced.

Other features and advantages of the disclosure will become more readily apparent with the detailed description given with the accompanying drawings below.

DETAILED DESCRIPTION OF THE EMBODIMENTS

Implementation details of the disclosure are described with the accompanying drawings below.

First Embodiment

Figure 2:
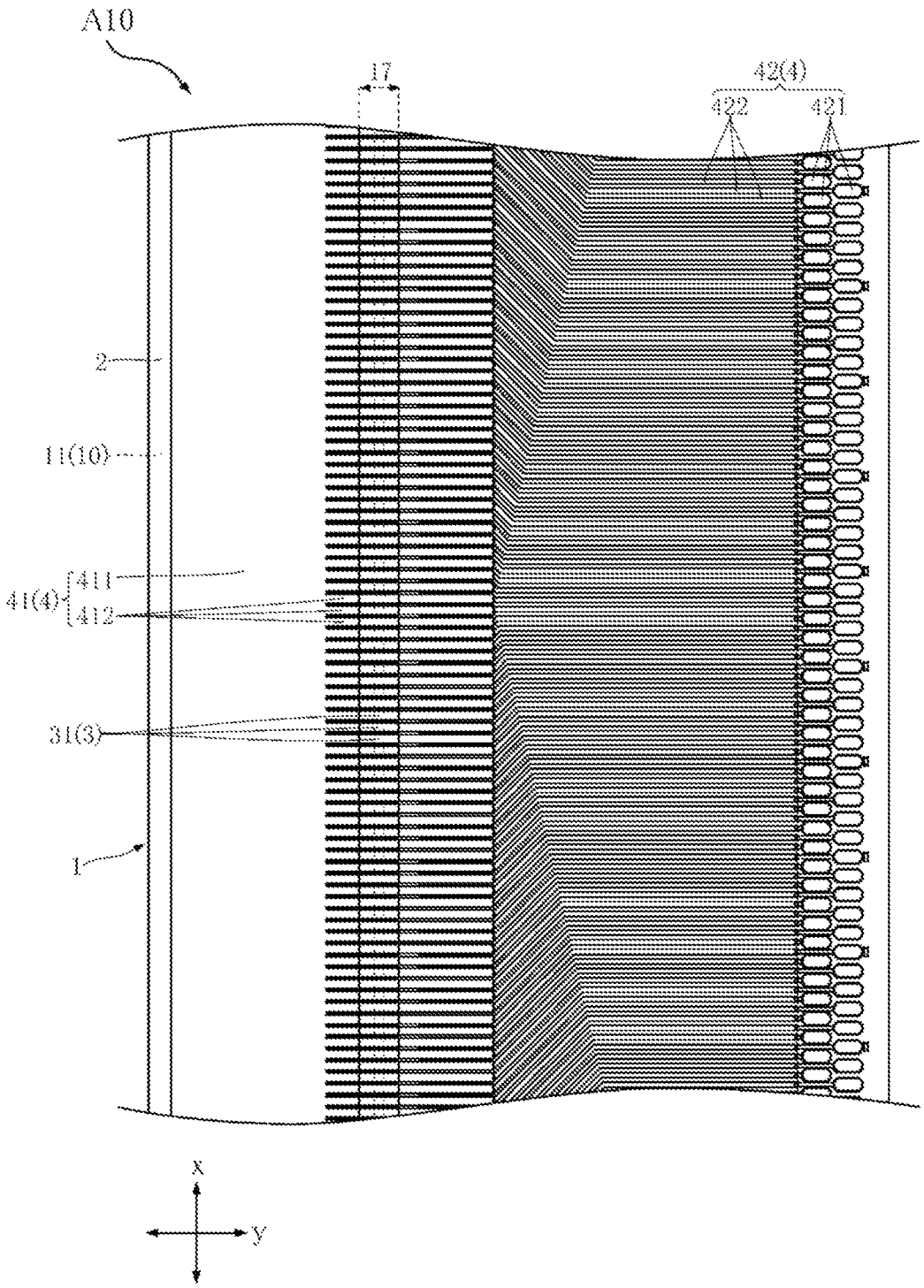
FIG. 2 is a top view of a main part of the thermal print head in FIG. 1.
Figure 3:
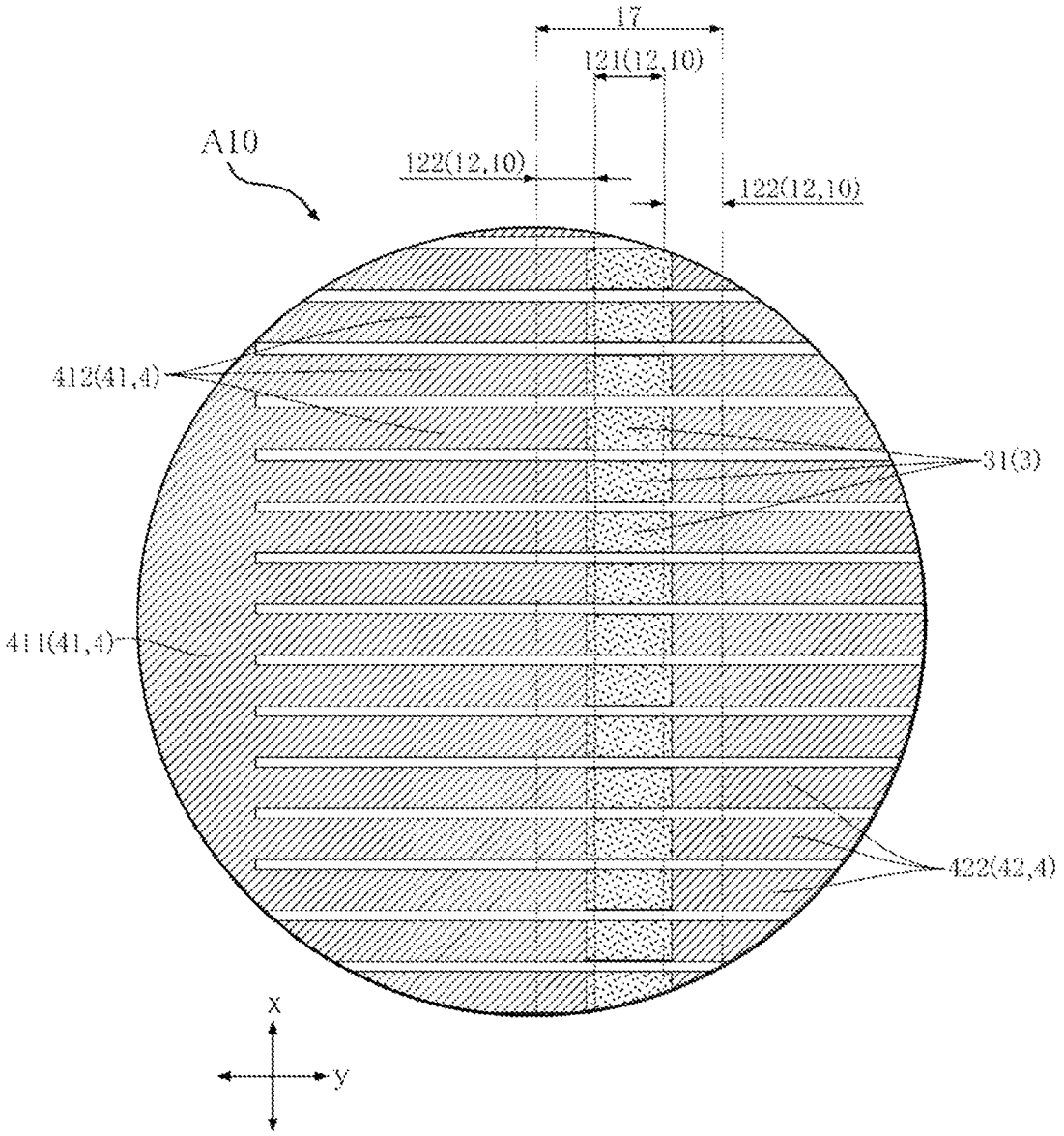
FIG. 3 is an enlarged partial view of FIG. 2.

On the basis of FIG. 1 to FIG. 6, a thermal print head A10 according to a first embodiment of the disclosure is described below. The thermal print head A10 forms the main part of a thermal printer B10 to be described later. The thermal print head A10 is formed by the main part and a secondary part. The main part of the thermal print head A10 includes a substrate 1, an insulation layer 2, a resistance layer 3, a wiring layer 4, a protection layer 5 and a coating layer 6. The secondary part of the thermal print head A10 includes a wiring substrate 71, a heat dissipation plate 72, multiple driving elements 73, multiple first conducting wires 74, multiple second conducting wires 75, sealing resin 76 and a connector 77. Further, in FIG. 1, the protection layer 5, the coating layer 6, the multiple first conducting wires 74, the multiple second conducting wires 75 and the sealing resin 76 are omitted. In FIG. 2 and FIG. 3, the protection layer 5 and the coating layer 6 are omitted.

Further, for better illustration, the main scan direction of the thermal print head A10 is referred to as the "x direction", the secondary scan direction of the thermal print head A10 is referred to as the "y direction", and the thickness direction of the substrate 1 is referred to as the "z direction". The z direction is perpendicular to both the x direction and the y direction. In the description below, "observed along the z direction" means "observed along the thickness direction".

Figure 4:
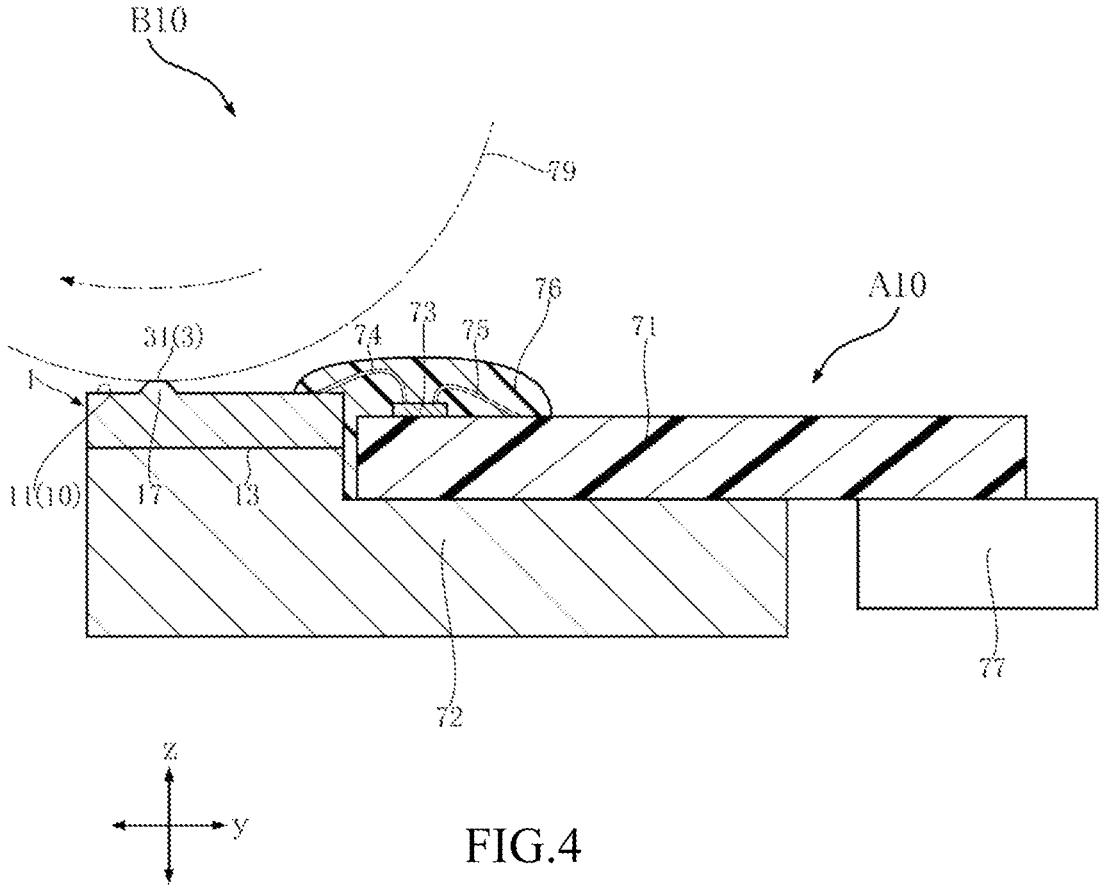
FIG. 4 is a section diagram of FIG. 1 along the line IV-IV.

In the thermal print head A10, as shown in FIG. 4, the substrate 1 forming the main part of the thermal print head A10 is joined with the heat dissipation plate 72. Further, the wiring substrate 71 is located near the substrate 1 in they direction. The wiring substrate 71 and the substrate 1 are similarly fixed on the heat dissipation plate 72. On the substrate 1, multiple heating portions 31 (with the details to be given later) forming a part of the resistance layer 3 and arranged in the x direction are formed. The multiple heating portions 31 selective generate heat through multiple driving elements 73 mounted on the wiring substrate 71. The multiple driving elements 73 perform driving according to a printing signal sent from the exterior through the connector 77.

Further, as shown in FIG. 4, the thermal printer B10 of the disclosure includes the thermal print head A10 and a pressure roller 79. In the thermal printer B10, the pressure roller 79 is a roller mechanism that transports a recording medium such as thermal paper. The pressure roller 70 presses the recording medium against the multiple heating portions 31, and the multiple heating portions 31 accordingly perform printing on the recording medium. In the thermal printer B10, a non-roller mechanism may be used in substitution for the pressure roller 79. The mechanism has a flat surface. Moreover, the flat surface has a curve surface with a smaller curvature. In thermal printer B10, a roller mechanism including such as the pressure roller 79 and the mechanism are collectively referred to as a "pressure plate". For better illustration, a supply side (the right of FIG. 4) of the recording medium in FIG. 4 is referred to an "upstream side", and a discharge side (the left of FIG. 4) of the recording medium in FIG. 4 is referred to a "downstream side".

Figure 1:
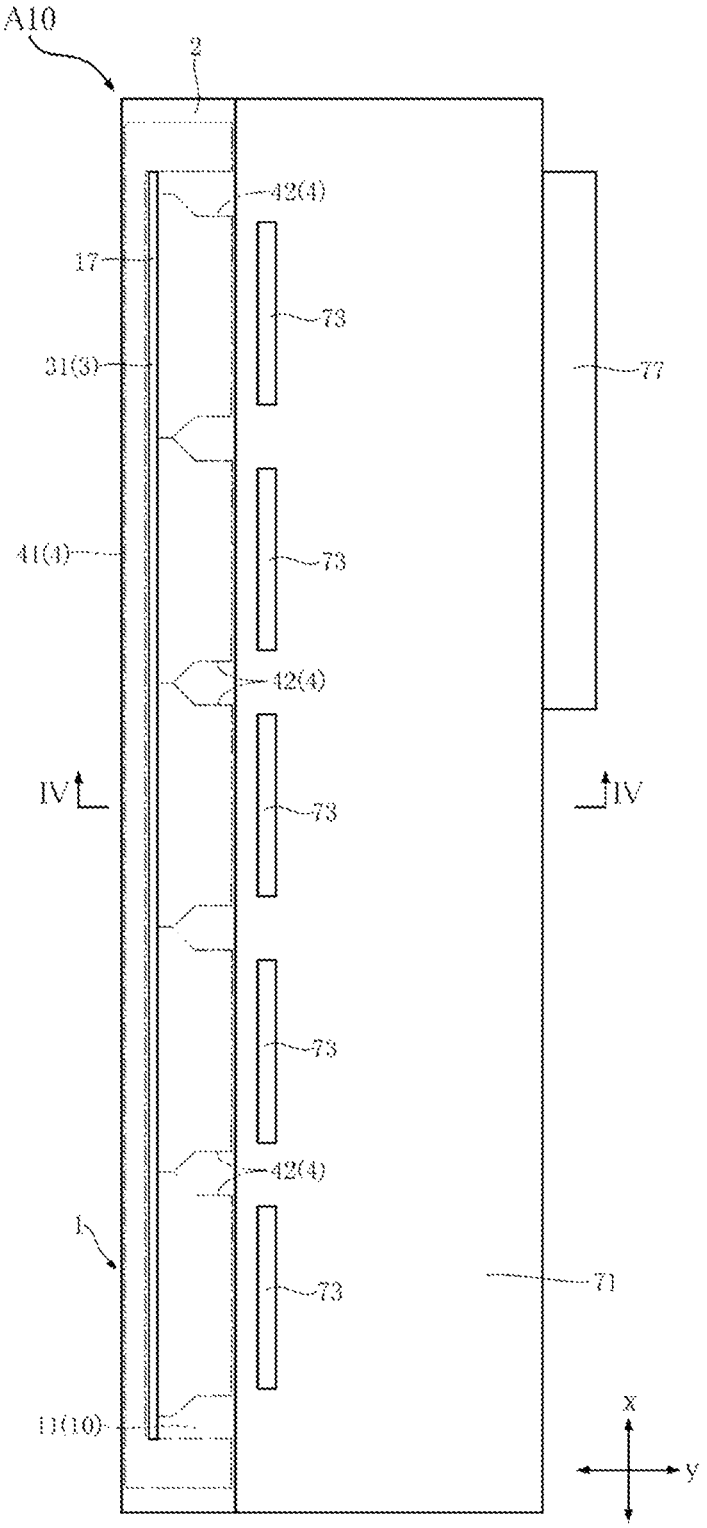
FIG. 1 is a top view of a thermal print head according to a first embodiment of the disclosure.

As shown in FIG. 1, the substrate 1 is a strip extending in the x direction when observed along the z direction. The substrate 1 includes a semiconductor material. The semiconductor material includes a monocrystalline material consisting of silicon (Si).

Figure 5:
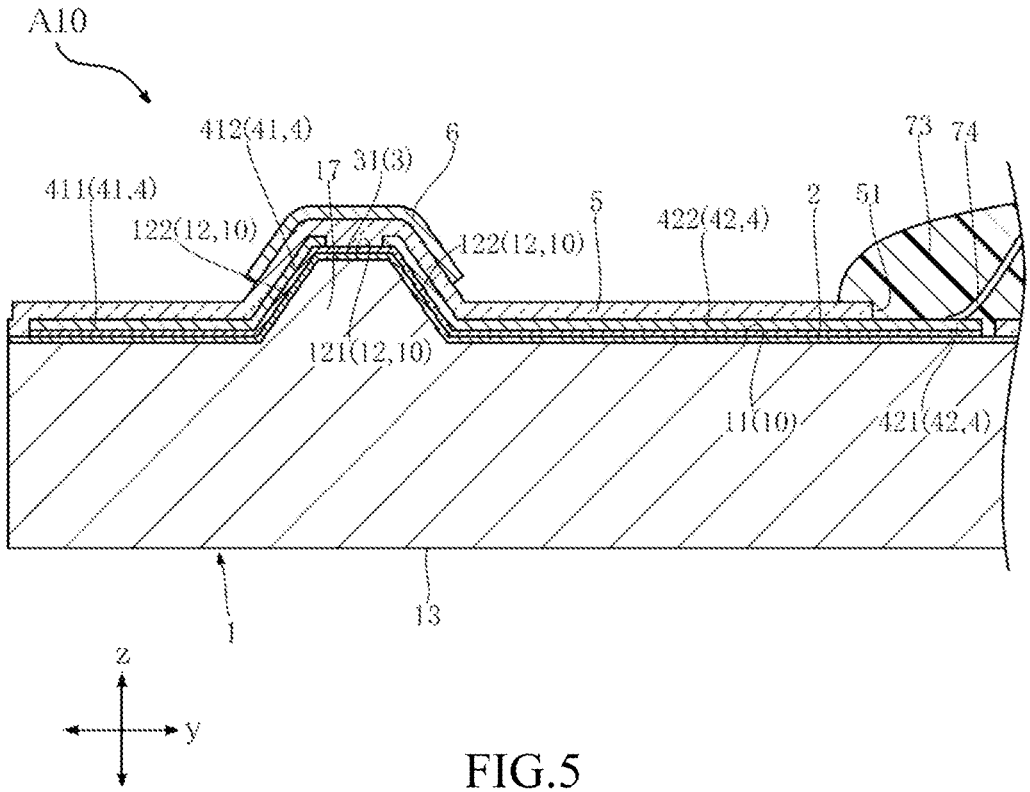
FIG. 5 is a section diagram of the main part of the thermal print head in FIG. 1.

As shown in FIG. 5, the substrate 1 has a main surface 10 and a back surface 13. The surface orientations of the main surface 10 and the back surface 13 of the crystalline structure of the substrate 1 are both (100) surfaces. The main surface 10 and the back surface 13 face opposite sides from each other in the z direction. As shown in FIG. 4, in the thermal print head A10, the main surface 10 is opposite to the pressure roller 79, and the back surface 13 is opposite to the wiring substrate 71. The main surface 10 further includes a base surface 11 and a protruding surface 12. The base surface 11 is parallel to the back surface 13. The protruding surface 12 protrudes in the z direction from the base surface 11. The protruding surface 12 extends along the x direction.

Figure 6:
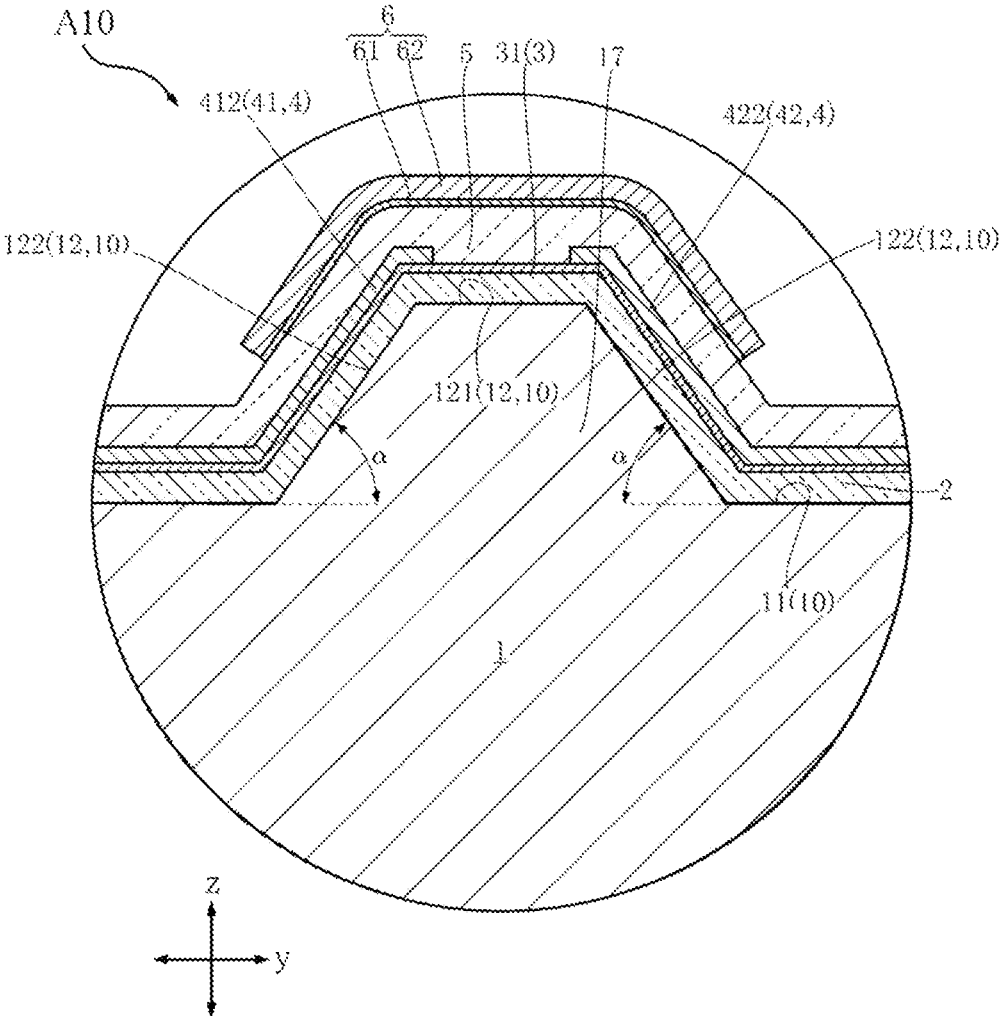
FIG. 6 is an enlarged partial view of FIG. 5.

As shown in FIG. 6, the protruding surface 12 has a top surface 121 and a pair of inclined surfaces 122. The top surface 121 is located on a position away from the base surface 11 in the z direction, and is parallel to the base surface 11. The pair of inclined surfaces 122 are on positions away from each other in the y direction. The pair of inclined surfaces 122 are connected to the top surface 121 and the base surface 11. The pair of inclined surfaces 122 are inclined relative to the base surface 11 in a way of approaching each other from the base surface 11 toward the top surface 121. Respective inclined angles $\alpha$ of the pair of inclined surfaces 122 relative to the base surface 11 are equal.

As shown in FIG. 6, a protrusion 17 is formed on the substrate 1. The protrusion 17 protrudes in the z direction from the base surface 11 and extends along the x direction. The protrusion surface 12 is the surface of the protrusion 17. Thus, the structure of the protruding surface 12 conforms to the shape of the protrusion 17.

As shown in FIG. 6, the insulation layer 2 covers the main surface 10 of the substrate 1. The substrate 1 is electrically insulated from the resistance layer 3 and the wiring layer 4 through the insulation layer 2. The insulation layer 2 includes, for example, silicon dioxide ($SiO_2$) with tetraethyl orthosilicate (TEOS) as the raw material. The thickness of the insulation layer 2 is, for example, more than 1 μm and less than 15 μm.

As shown in FIG. 5 and FIG. 6, the resistance layer 3 is formed on the main surface 10 of the substrate 1. The resistance layer 3 is connected to the insulation layer 2. Thus, in the thermal print head A10, the insulation layer 2 is sandwiched at the structure between the substrate 1 and the resistance layer 3. The resistance layer 3 includes, for example, tantalum nitride (TaN). The thickness of the resistance layer 3 is, for example, more than 0.02 μm and less than 0.1 μm.

As shown in FIG. 2, FIG. 3 and FIG. 6, the resistance layer 3 includes the multiple heating portions 31. In the resistance layer 3, the multiple heating portions 31 are parts exposed from the wiring layer 4. Electricity is selectively supplied to the multiple heating portions 31 via the wiring layer 4, so that the multiple heating portions 31 partially heat the recording medium. The multiple heating portions 31 are arranged in the x direction. Among the multiple heating portions 31, two adjacent heating portions 31 in the x direction are located on positions separated from each other. On the protruding surface 12 of the substrate 1, the multiple heating portions 31 are formed on the top surface 121. As shown in FIG. 4, in the thermal printer B10, the multiple heating portions 31 are opposite to the pressure roller 79. In the protruding surface 12, the multiple heating portions 31 may be formed in a way of crossing any of the top surface 121 and the pair of inclined surfaces 122.

As shown in FIG. 5 and FIG. 6, the wiring layer 4 is formed on the resistance layer 3. The wiring layer 4 forms a conductive path for supplying electricity to the multiple heating portions 31 of the resistance layer 3. The resistance rate of the wiring layer 4 is less than the resistance rate of the resistance layer 3. The wiring layer 4 is, for example, a metal layer including copper (Cu). The thickness of the wiring layer 4 is, for example, more than 0.3 μm and less than 2.0 μm. Moreover, the wiring layer 4 may be a structure including two metal layers, namely, a titanium (Ti) layer overlaying the resistance layer 3 and a copper layer overlaying the titanium layer. In this case, the thickness of the titanium layer is, for example, more than 0.1 μm and less than 0.2 μm.

As shown in FIG. 2, the wiring layer 4 includes a common wire 41 and multiple independent wires 42. The common wire 41 is located on one side in they direction relative to the multiple heating portions 31 of the resistance layer 3. The multiple independent wires 42 are located on the other side in the y direction relative to the multiple heating portions 31. As shown in FIG. 3, when observed along the z direction, multiple regions in the resistance layer 3 that are sandwiched between the common wire 41 and the multiple independent wires 42 are the multiple heating portions 31.

As shown in FIG. 2 and FIG. 3, the common wire 41 includes a base portion 411 and multiple extension portions 412. In they direction, the base portion 411 is located on a position farthest away from the multiple heating portions 31 of the resistance layer 3. The base portion 411 is a strip extending in the x direction when observed along the z direction. The multiple extension portion 412 is a strip extending from an end part of the base portion 411 opposite to the protrusion 17 of the substrate 1 in the y direction toward the multiple heating portions 31. The multiple extension portions 412 are arranged in the x direction. A part of each of the multiple extension portions 412 is formed on the inclined surface 122 opposite to the base portion 411 between the pair of inclined surfaces 122 of the substrate 1. Thus, a part of the common wire 41 is formed on any one of the pair of inclined surfaces 122. In the common wire 41, a current flows from the base portion 411 through the multiple extension portions 412 to the multiple heating portions 31.

As shown in FIG. 2 and FIG. 3, each of the multiple independent wires 42 has the base portion 421 and the extension portions 422. In the y direction, the base portion 421 is located on a position farthest away from the multiple heating portions 31 of the resistance layer 3. The base portions 421 of the multiple independent wires 42 are in an alternating arrangement in the x direction. Each extension portion 422 is a strip extending from an end part of the base portion 421 opposite to the protrusion 17 of the substrate 1 in they direction toward the multiple heating portions 31. The extension portions 422 of the multiple independent wires 42 are arranged in the x direction. Each of the multiple extension portions 422 of the multiple independent wires 42 is formed between the pair of inclined surfaces 122 of the substrate 1 on the inclined surface 122 opposite to the base portions 421 of the multiple independent wires 42. Thus, a part of each of the independent wires 42 is formed on any one of the pair of inclined surfaces 122. In the multiple independent wires 42, a current flows from any heating portion among the multiple heating portions 31 through the extension portion 422 to the base portion 421. When observed along the z direction, each of the multiple heating portions 31 is sandwiched between any extension portion among the extension portions 422 of the multiple independent wires 42 and any extension portion among the multiple extension portions 412 of the common wire 41.

As shown in FIG. 5, the protection layer 5 covers a part of the main surface 10 of the substrate 1, the multiple heating portions 31 of the resistance layer 3 and the wiring layer 4. The protection layer 5 is electrically insulative. The protection layer 5 includes silicon. The protection layer 5 includes, for example, any of silicon dioxide, silicon nitride ($Si_3N_4$) and silicon carbide (SiC). Alternatively, the protection layer 5 may be a layered body including multiple substances of the substances above. The thickness of the protection layer 5 is, for example, more than 1.0 μm and less than 10 μm. In the thermal printer B10, the recording medium is pressed by the pressure roller 79 shown in FIG. 4 to the region of the protection layer 5 covering the multiple heating portions 31, for example.

As shown in FIG. 6, a wire opening 51 is provided on the protection layer 5. The wire opening 51 passes through the protection layer 5 in the z direction. A part of each of the base portions 421 of the multiple independent wires 42 and the extension portions 422 of the multiple independent wires 42 is exposed from the wire opening 51.

As shown in FIG. 5, a coating layer 6 covers at least a part of the protection layer 5. The coating layer 6 overlaps with the multiple heating portions 31 of the resistance layer 3 when observed along the z direction. Further, the coating layer 6 overlaps with the protruding surface 12 of the substrate 1 when observed along the z direction. As shown in FIG. 6, the coating layer 6 has a base layer 61 and a body layer 62. Each of the base layer 61 and the body layer 62 includes a metal element. The metal elements respectively included in the base layer 61 and the body layer 62 are bonded to each other by a metal bond. Thus, the coating layer 6 is a conductor in which a current can easily flow. The base layer 61 is connected to the protection layer 5. The base layer 61 is formed by a barrier layer connected to the protection layer 5 and a crystal seed layer layered on the barrier layer. The metal element included in the barrier layer is, for example, titanium. The metal element included in the crystal seed layer is, for example, copper. The body layer 62 is layered on the base layer 61. The thickness of the body layer 62 is more than the thickness of the base layer 61. The Vickers hardness (HV) of the body layer 62 is more than the Vickers hardness of the protection layer 5. The metal element included in the body layer 62 is, for example, copper. Further, the metal element included in the body layer 62 may also be nickel (Ni).

The wiring substrate 71 is located near the substrate 1 in the y direction, as shown in FIG. 4. As shown in FIG. 1, the multiple independent wires 42 are located between the multiple heating portions 31 of the resistance layer 3 and the wiring substrate 71 in the y direction, when observed along the z direction. The area of the wiring substrate 71 is greater than the area of the substrate 1, when observed along the z direction. Moreover, when observed along the z direction, the wiring substrate 71 is a rectangle having the x direction as the lengthwise direction. The wiring substrate 71 is, for example, a printed circuit board (PCB) substrate. Multiple driving elements 73 and a connector 77 are mounted on the wiring substrate 71.

As shown in FIG. 4, the heat dissipation plate 72 is opposite to the back surface 13 of the substrate 1. The back surface 13 is joined with the heat dissipation plate 72. The wiring substrate 71 is fixed on the heat dissipation plate 72 by fastening components such as screws. During the use of the thermal print head A10, a part of heat energy generated by the multiple heating portions 31 of the resistance layer 3 is transmitted to the heat dissipation plate 72 through the substrate 1. The heat energy transmitted to the heat dissipation plate 72 is radiated to the exterior. The heat dissipation plate 72 includes, for example, aluminum (Al).

The multiple driving elements 73 are mounted on the wiring layer 71 through an electrically insulative chip bonding material (omitted from the drawing), as shown in FIG. 1 and FIG. 4. The multiple driving elements 73 are semiconductor devices respectively forming various circuits. Each of the multiple driving elements 73 is bonded to one end of each of multiple first conducting wires 74 and one end of each of multiple second conducting wires 75. The other end of each of the multiple conducting wires 74 is independently bonded to the base portions 421 of the multiple independent wires 42. The other end of each of the multiple second conducting wires 75 is bonded to a wire (omitted from the drawing), which is provided at the wiring substrate 71 and electrically connected to the connector 77. Accordingly, a printing signal, a control signal and the voltage of the multiple heating portions 31 of the resistance layer 3 are inputted to the multiple driving elements 73 through the connector 77 from the exterior. The multiple driving elements 73 selectively apply the voltage to the multiple independent wires 42 according to the electrical signals. Accordingly, the multiple heating portions 31 selectively generate heat.

As shown in FIG. 4, the sealing resin 76 covers a part of each of the multiple driving elements 73, the multiple first conducting wires 74, the multiple second conducting wires 75, the substrate 1 and the wiring substrate 71. The sealing resin 76 is electrically insulative. The sealing resin 76 is, for example, black and soft composite resin for filling the bottom.

The connector 77 is mounted on one end of the wiring substrate 71 in the y direction, as shown in FIG. 1 and FIG. 4. The connector 77 is connected to the thermal printer B10. The connector 77 has multiple pins (omitted from the drawing). A part of the multiple pins are on the wiring substrate 71, and are electrically connected to wires (omitted from the drawing) bonded with the multiple second wires 75. Moreover, a part of the multiple pins on the wiring substrate 71 are electrically connected to wires (omitted from the drawing) of the base portion 411 bonded with the common wire 41.

Details of an example of the manufacturing method of the thermal print head A10 are given with reference to FIG. 7 to FIG. 18 below. Herein, cross section positions of FIG. 7 to FIG. 18 (excluding FIG. 16 and FIG. 17) are the same as the cross section position for representing the main part of the thermal print head A10 in FIG. 5.

Figure 7:
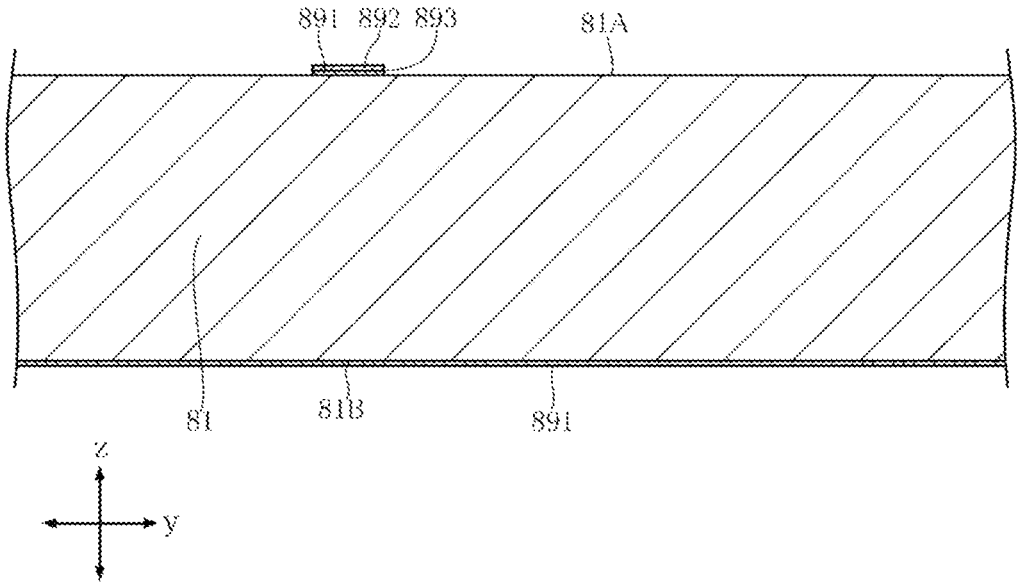
FIG. 7 is a section diagram of a manufacturing step for the main part of the thermal print head in FIG. 1.
Figure 8:
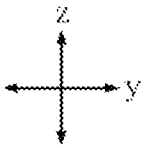
FIG. 8 is a section diagram of a manufacturing step for the main part of the thermal print head in FIG. 1.

Initially, as shown in FIG. 7 and FIG. 8, the protrusion 17 is formed on a base material 81.

First, as shown in FIG. 7, a first mask layer 891 covering the base material 81 and a second mask layer 892 covering a part of the first mask layer 891 are formed. The base material 81 includes a semiconductor material. The semiconductor material includes a monocrystalline material consisting of silicon. The base material 81 is silicon wafer. In a direction perpendicular to the z direction, regions respectively equivalent to multiple substrates 1 are connected to equivalently form the base material 81. The base material 81 has a first surface 81A and a second surface 81B. The first surface 81A and the second surface 81B face opposite sides from each other in the z direction. The surface orientations of the first surface 81A and the second surface 81B of the crystalline structure of the base material 81 are both (100) surfaces. The first mask layer 891 is formed in a way of covering the first surface 81A and the second surface 81B. The first mask layer 891 includes silicon dioxide. The second mask layer 892 is formed in a way of covering a region of the first mask layer 891 covering the first surface 81A. The second mask layer 892 includes silicon nitride. A mask opening 893 that passes through in the z direction is formed in the region of the first mask layer 891 covering the first surface 81A and the second mask layer 892 covering the region.

To form the first mask layer 891 and the second mask layer 892, a silicon dioxide film covering the first surface 81A and the second surface 81B is first formed by means of thermal oxidation. Next, a silicon nitride film covering the region of the first mask layer 891 covering the first surface 81A is formed by means of thermal chemical vapor deposition (CVD). Lastly, a part of the region of the silicon dioxide film covering the first surface 81A and a part of the silicon nitride film covering the region are removed by means of etching patterning and reactive ion etching (RIE). Accordingly, the first mask layer 891 and the second mask layer 892 are formed, and the mask opening 893 is formed in the region of the first mask layer 891 covering the first surface 81A and the second mask layer 892 covering the region.

Next, as shown in FIG. 8, the main surface 10 and the protrusion 17 are formed on the base material 81. The main surface 10 and the protrusion 17 are formed in the region of the first surface 81A exposed through the mask opening 893 shown in FIG. 7 by means of wet etching using aqueous solution of potassium hydroxide (KOH). The etching is anisotropic. Lastly, the first mask layer 891 and the second mask layer 892 are removed by means of wet etching using hydrofluoric acid (HF). As described above, the main surface 10 including the base surface 11 and the protruding surface 12 and the protrusion 17 are formed on the base material 82. Further, the second surface 81B of the base material 81 becomes the back surface 13. The protruding surface 12 protrudes in the z direction from the base surface 11. The protrusion 17 protrudes in the z direction from the base surface 11 and extends along the x direction. The protrusion 17 includes the protruding surface 12. A region of the first surface 81A covered by the first mask layer 891 and the second mask layer 892 forms the top surface 121 of the protruding surface 12. Moreover, respective inclined angles $\alpha$ of the pair of inclined surfaces 122 of the protruding surface 12 relative to the base surface 11 are equal. This is because the protrusion 17 is formed by anisotropic etching.

Figure 9:
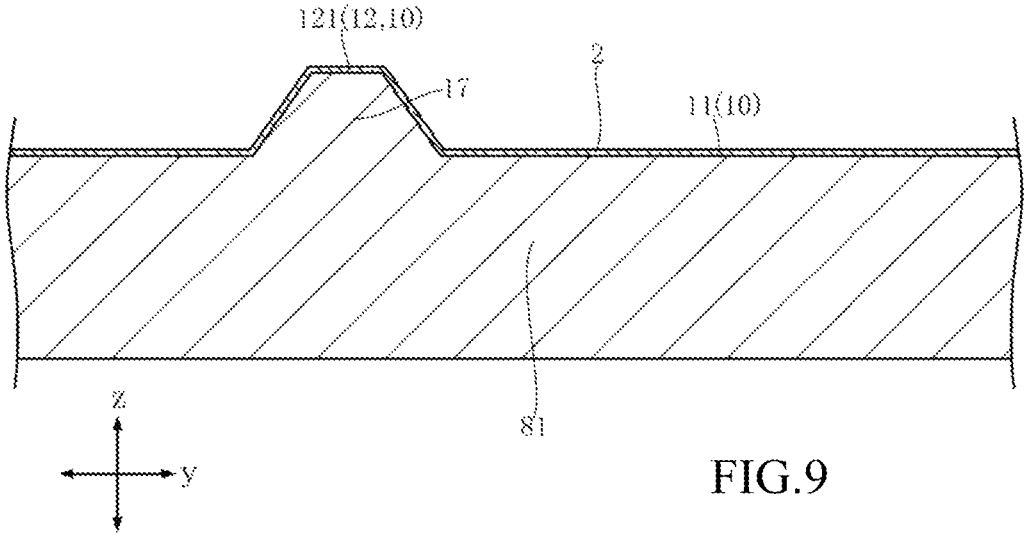
FIG. 9 is a section diagram of a manufacturing step for the main part of the thermal print head in FIG. 1.

Next, as shown in FIG. 9, the insulation layer 2 covering the main surface 10 of the base material 81 is formed. The insulation layer 2 is formed by overlaying multiple silicon dioxide films, wherein the silicon dioxide film is formed by means of plasma chemical vapor deposition (CVD) using tetraethyl orthosilicate (TEOS) as the raw material.

Figure 10:
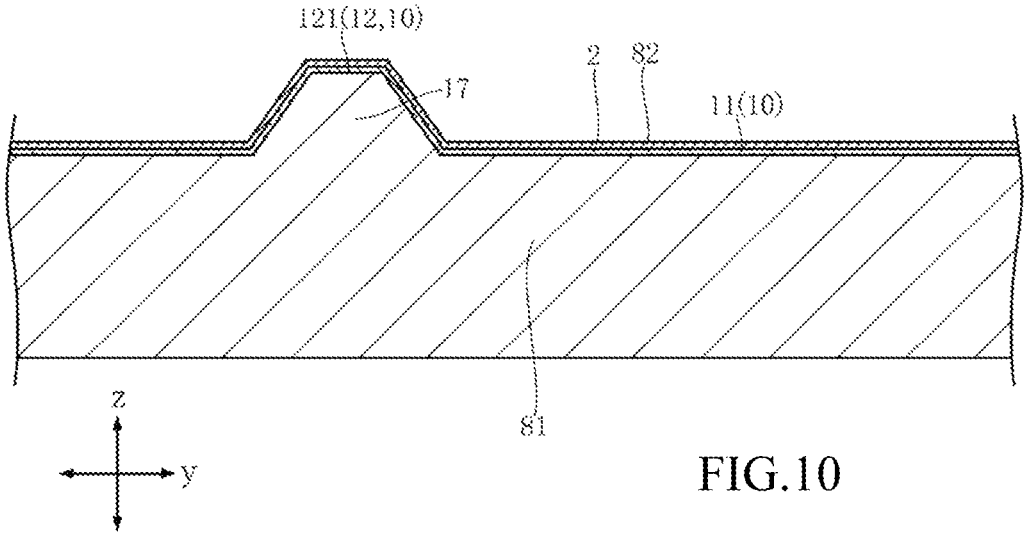
FIG. 10 is a section diagram of a manufacturing step for the main part of the thermal print head in FIG. 1.
Figure 13:
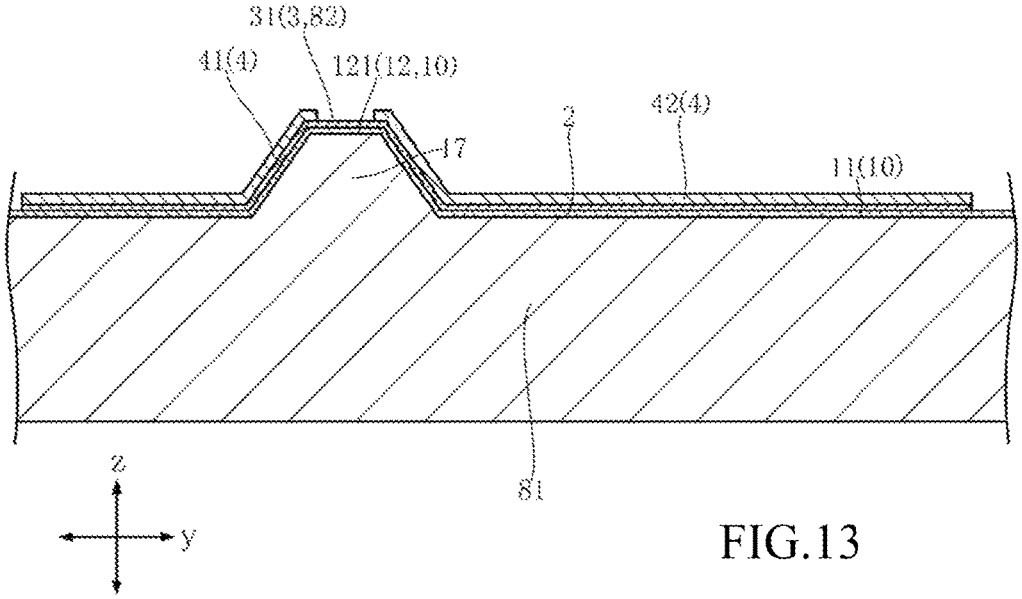
FIG. 13 is a section diagram of a manufacturing step for the main part of the thermal print head in FIG. 1.

Next, as shown in FIG. 10 and FIG. 13, the resistance layer 3 and the wiring layer 4 are formed. The resistance layer 3 includes the multiple heating portions 31 arranged in the x direction. The wiring layer 41 is electrically connected to the multiple heating portions 31. The step of forming the wiring layer 4 includes a step of forming a common wire 41 and multiple independent wires 42. On the base material 81, the common wire 41 is located on one side in they direction relative to the multiple heating portions 31 of the resistance layer 3 shown in FIG. 13. On the base material 81, the multiple independent wires 42 are located on the other side in the y direction relative to the multiple heating portions 31 shown in FIG. 13.

First, as shown in FIG. 10, a resistance film 82 is formed on the main surface 10 of the base material 81. The resistance film 82 is formed in a way of covering the entire surface of the insulation layer 2. The resistance film 82 is formed on the insulation layer 2 by layering a tantalum nitride film by means of sputtering.

Figure 11:
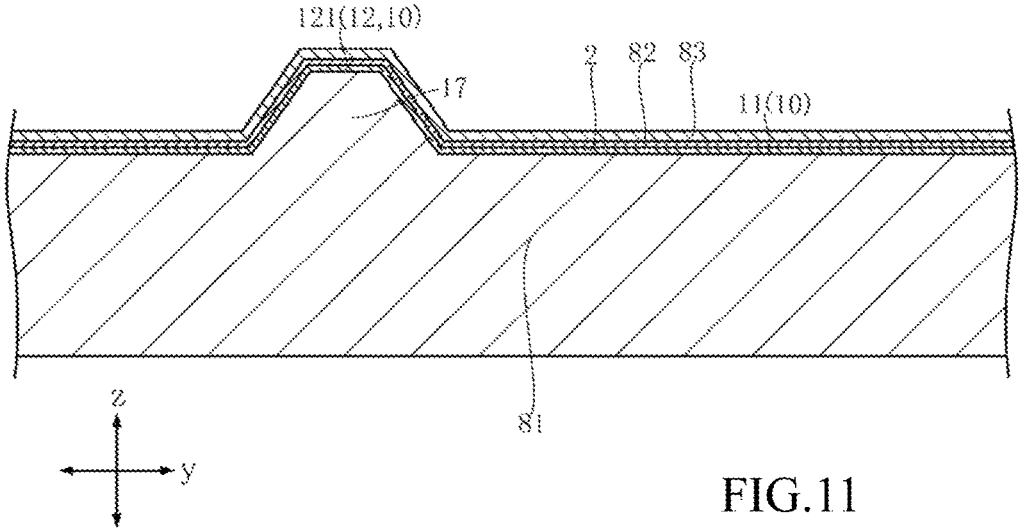
FIG. 11 is a section diagram of a manufacturing step for the main part of the thermal print head in FIG. 1.

Next, as shown in FIG. 11, a conductive layer 83 covering the entire surface of the resistance film 82 is formed. The conductive layer 83 is formed on the resistance film 82 by layering a copper film for multiple times by means of sputtering. Further, when forming the conductive layer 83, the following method may also be adopted: after layering a titanium film on the resistance film 82 by means of sputtering, layering a copper film for multiple times on the titanium film by means of sputtering.

Figure 12:
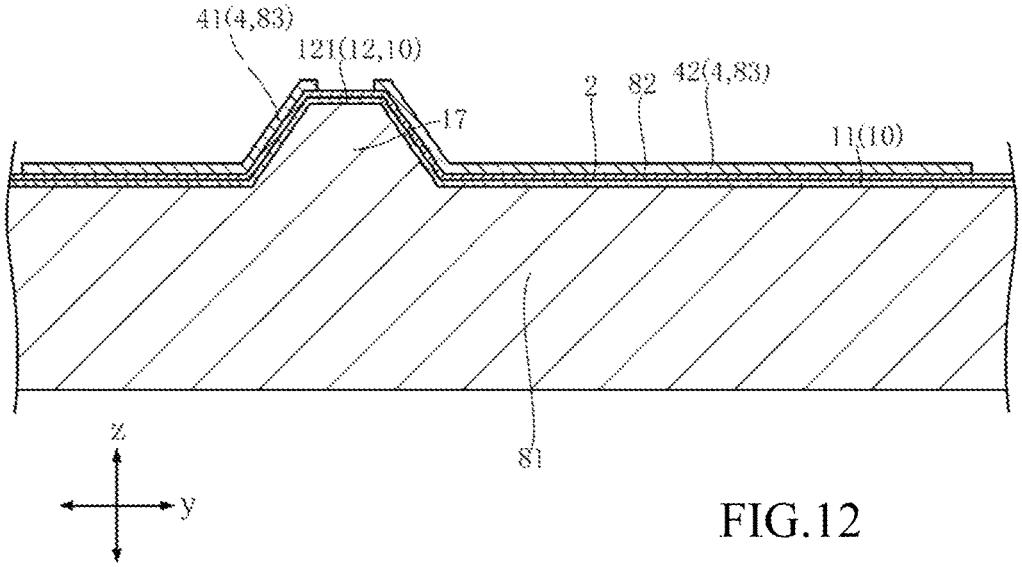
FIG. 12 is a section diagram of a manufacturing step for the main part of the thermal print head in FIG. 1.

Next, as shown in FIG. 12, a part of the conductive layer 83 is removed after performing etching patterning on the conductive layer 83. The removing is performed by means of wet etching using mixed solution of sulfuric acid ($H_2SO_4$) and hydrogen peroxide ($H_2O_2$). Accordingly, the common wire 41 and the multiple dependent wires 42 are formed on the resistance film 82. Thus, the wiring layer 4 is formed by the steps above. Moreover, a region of the resistance film 82 formed on the top surface 121 (the protruding surface 12) of the base material 81 is exposed from the wiring layer 4.

Next, as shown in FIG. 13, a part of the resistance film 82 is removed after performing etching patterning on the resistance film 82 and the wiring layer 4. The removing is performed by means of reactive ion etching. Accordingly, the resistance layer 3 is formed on the main surface 10 of the base material 81. On the top surface 121 of the base material 81, the multiple heating portions 31 are provided.

Figure 14:
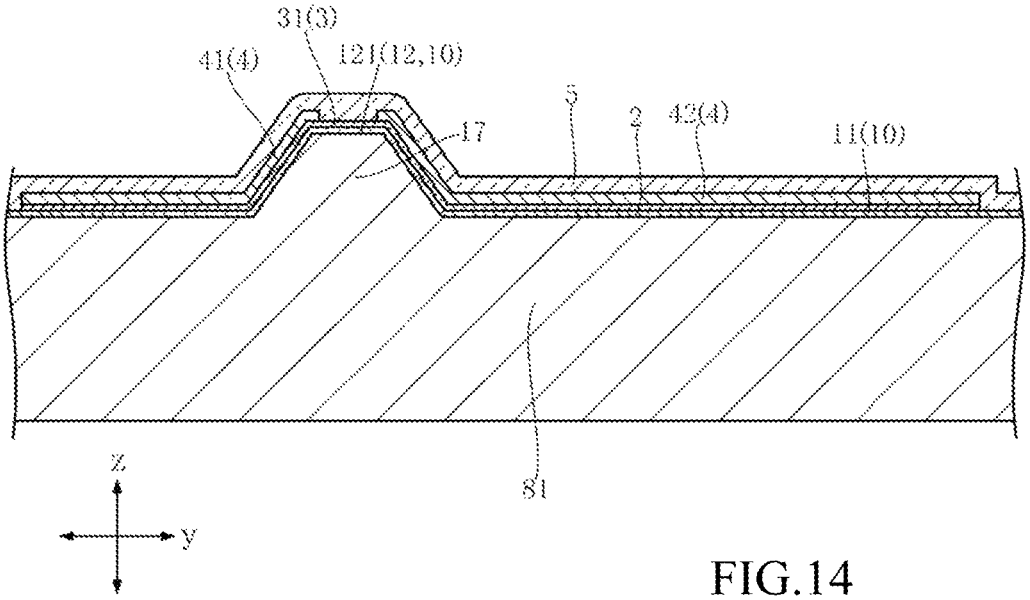
FIG. 14 is a section diagram of a manufacturing step for the main part of the thermal print head in FIG. 1.

Next, as shown in FIG. 14, the protection layer 5 covering a part of the main surface 10 of the base material 81, the multiple heating portions 31 of the resistance layer 3 and the wiring layer 4 is formed. The protection layer 5 is formed by layering a silicon nitride film by means of plasma CVD.

Figure 15:
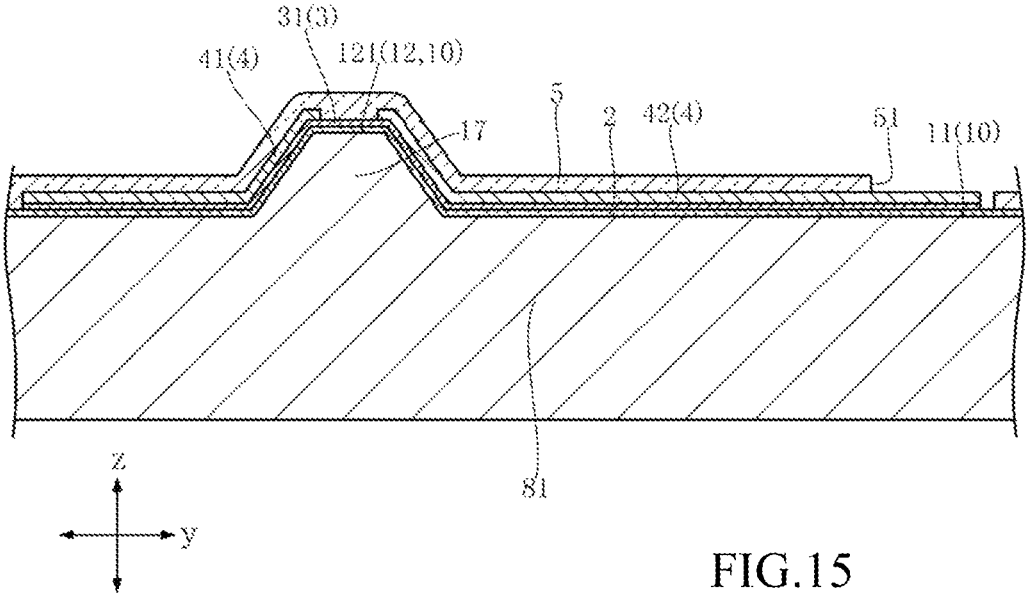
FIG. 15 is a section diagram of a manufacturing step for the main part of the thermal print head in FIG. 1.

Next, as shown in FIG. 15, the wire opening 51 passing through in the z direction is formed on the protection layer 5. The wire opening 51 is formed by removing a part of the protection layer 5 after performing etching patterning on the protection layer 5. The removing is performed by means of reactive ion etching. Accordingly, a part of each of the multiple independent wires 42 (such as a part of each of the base portions 421 of the multiple independent wires 42 and the extension portions 422 of the multiple independent wires 42) is exposed from the wire opening 51.

Figure 16:
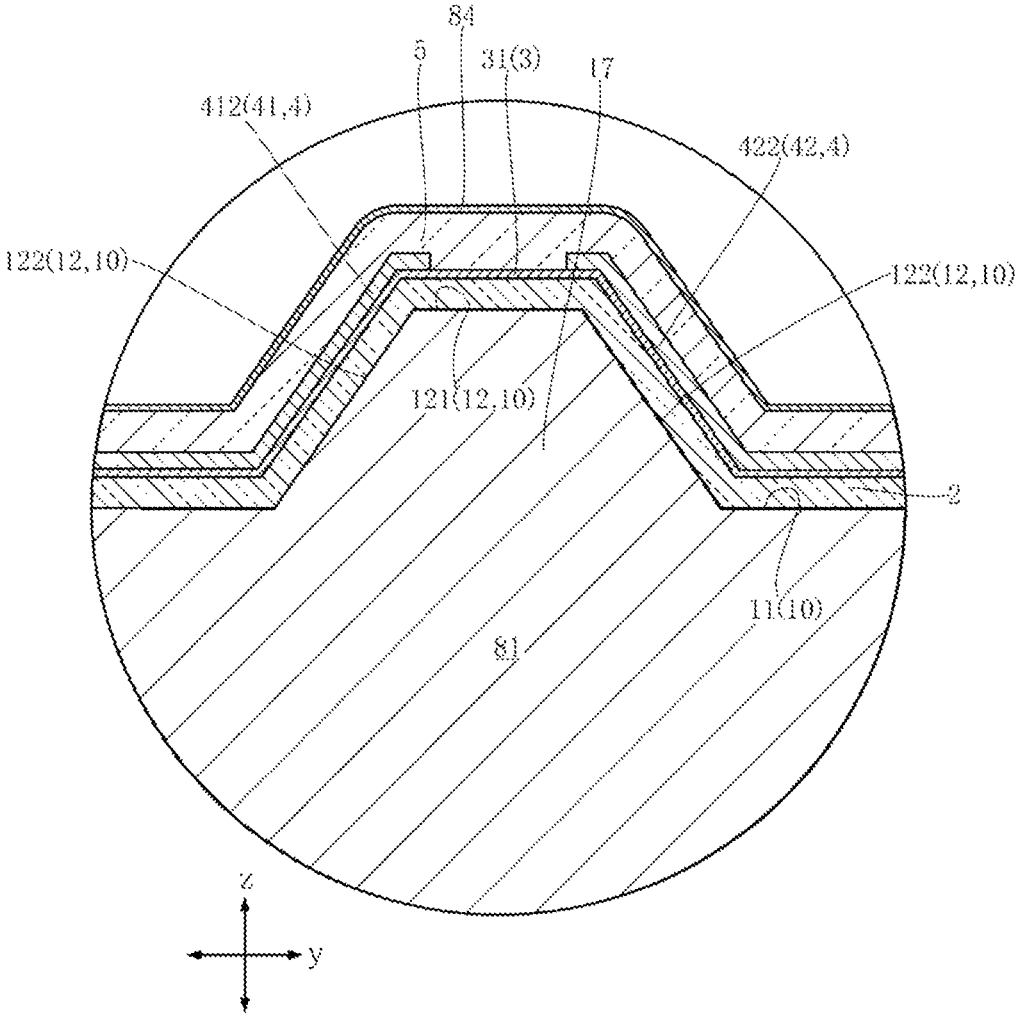
FIG. 16 is an enlarged partial diagram of a manufacturing step for the main part of the thermal print head in FIG. 1.
Figure 17:
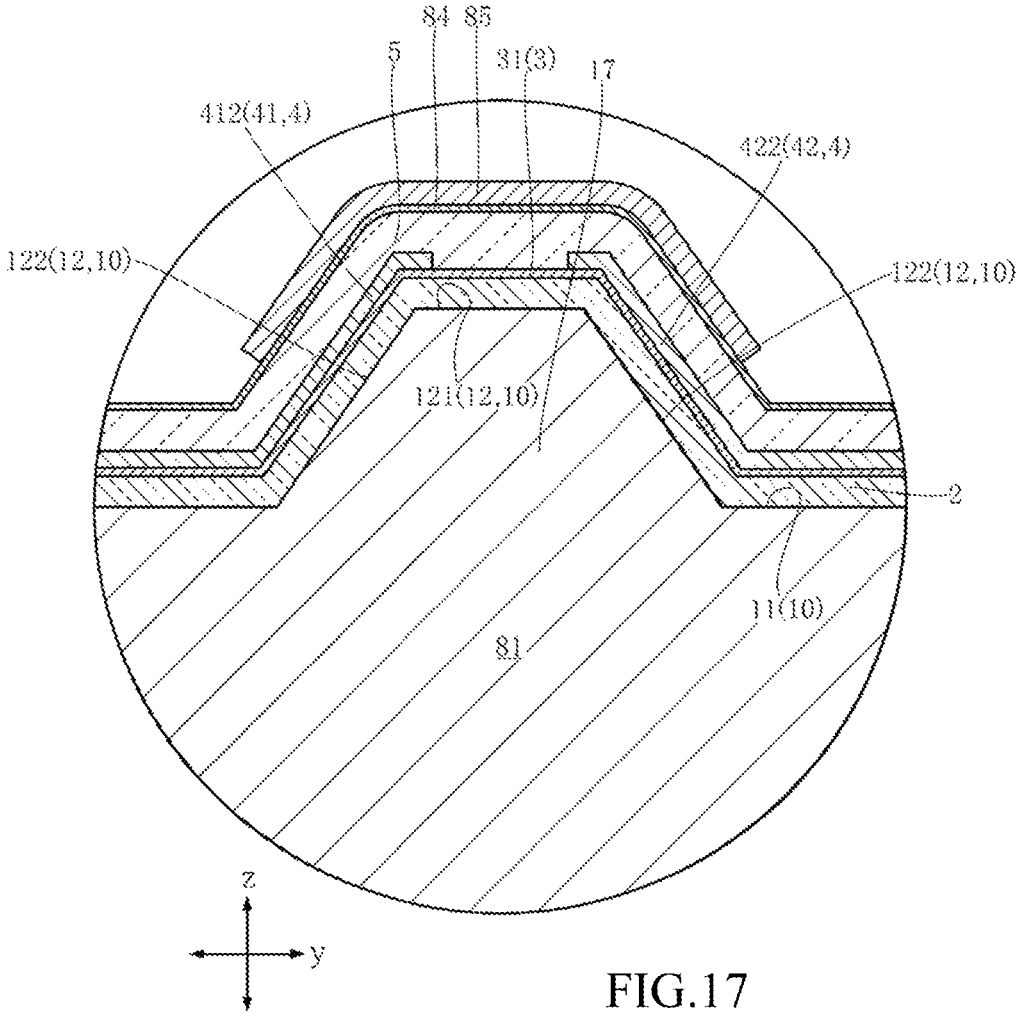
FIG. 17 is an enlarged partial diagram of a manufacturing step for the main part of the thermal print head in FIG. 1.
Figure 18:
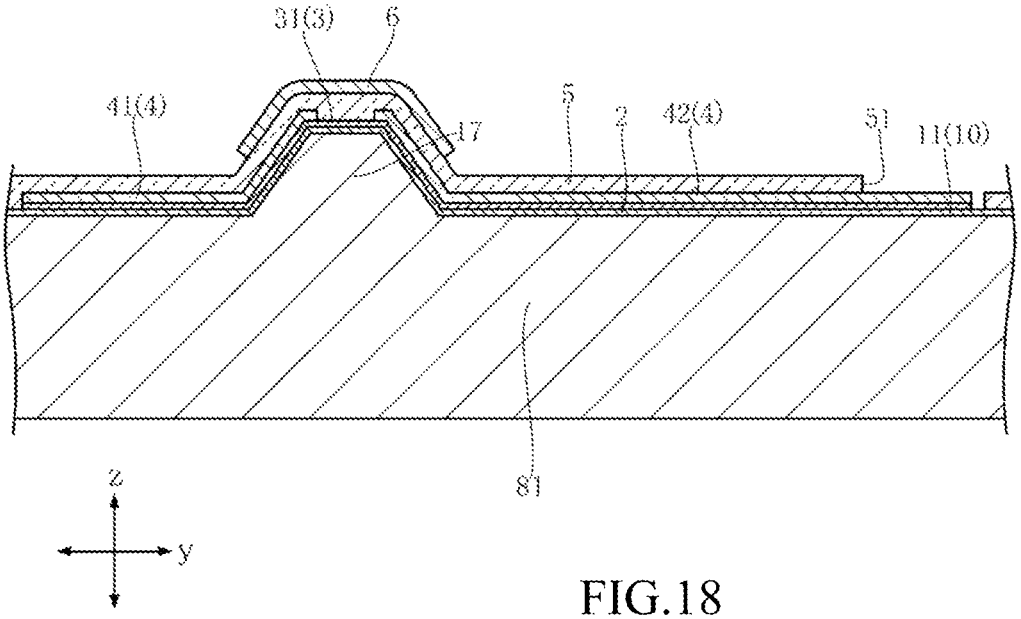
FIG. 18 is a section diagram of a manufacturing step for the main part of the thermal print head in FIG. 1.

Next, as shown in FIG. 16 to FIG. 18, the coating layer 6 covering at least a part of the protection layer 5 is formed. The step of forming the coating layer 6 includes a step of forming the base layer 61 connected to the protection layer 5 and including a metal element, and a step of forming the body layer 62 overlaying the base layer 61 and including a metal element.

First, as shown in FIG. 16, the base layer 61 covering the protection layer 5 and a part of the multiple independent wires 42 exposed form the wire opening 51 of the protection layer 5 is formed. The base layer 61 is formed by the following: after layering a titanium film on the protection layer 5 by means of sputtering and exposing a part of the multiple independent wires 42 through the wire opening 51, layering a copper film on the titanium film by means of sputtering.

Next, as shown in FIG. 17, the body layer 62 is formed on the base layer 61. The body layer 62 includes copper. The body layer 62 is formed by means of plating after performing etching patterning on the base layer 61. The coating may be formed by electroplating or electroless-plating. When the coating is electroplating, the body layer 62 is formed by using the base layer 61 as a conductive path.

Next, as shown in FIG. 18, a region of the base layer 61 not covered by the body layer 62 is removed. The removing is performed by means of wet etching using mixed solution of sulfuric acid and hydrogen peroxide. Accordingly, the coating layer 6 is formed.

Next, the base material 81 is cut along the x direction and the y direction to cut the base material 81 into single pieces. Accordingly, the main part of the thermal print head A10 including the substrate 1 can be obtained. Next, multiple driving elements 73 and the connector 77 are mounted on the wiring substrate 71. Next, the back surface 13 of the substrate 1 and the wire substrate 71 are joined to the heat dissipation plate 72. Next, the multiple first conducting wires 74 and the multiple second conducting wires 75 are joined for the wire substrate 71. Lastly, the sealing resin 76 covering the driving elements 73, the multiple first conducting wires 74 and the multiple second conducting wires 75 is formed for the substrate 1 and the wiring substrate 71. The thermal print head A10 is obtained by the steps above.

Next, effects of the thermal print head A10 are given below.

The thermal print head A10 includes: the protection layer 5, covering a part of the main surface 10 of the substrate 1, the multiple heating portions 31 of the resistance layer 3 and the wiring layer 4; and the coating layer 6, covering at least a part of the protection layer 5. The coating layer 6 overlaps with the multiple heating portions 31 when observed along the z direction. The coating layer 6 has the base layer 62 connected to the protection layer 5, and the body layer 62 overlaying the base layer 61. Each of the base layer 61 and the body layer 62 includes a metal element. Accordingly, the recording medium is in contact with the coating layer 6 during the use of the thermal print head A10. Thus, with the structure in which the recording medium does not come into contact with the protection layer 5, wear-resistance of the thermal print head A10 against the recording medium can be enhanced.

The base layer 61 of the coating layer 6 includes a metal element. Accordingly, the base layer 61 can be formed by means of sputtering. Moreover, the body layer 62 of the coating layer 6 also includes a metal element. Accordingly, the body layer 62 can be formed by depositing a metal element on the base layer 61 by means of plating. Thus, according to the structure above, the coating layer 6 can be easily and efficiently formed. As described above, according to the thermal print head A10, low manufacturing efficiency can be suppressed, and wear-resistance of thermal print head A10 against a recording medium can be enhanced.

The metal elements respectively included in the base layer 61 and the body layer 62 of the coating layer 6 are bonded to each other by a metal bond. Accordingly, the base layer 61 and the body layer 62 respectively become conductors in which a current can easily flow. Thus, the body layer 62 can be formed by means of electroplating using the base layer 61 as a current path. Accordingly, low manufacturing efficiency of the thermal print head A10 can be further suppressed.

The Vickers hardness of the body layer 62 of the coating layer 6 is more than the Vickers hardness of the protection layer 5. In seek of wear-resistance of the thermal print head A10 against the recording medium, such physical property is preferred. Further, the coefficient of dynamic friction of the body layer 62 is preferably smaller. Accordingly, paper bits caused by the recording medium can be avoided from attaching to the coating layer 6 during the use of the thermal print head A10.

The main surface 10 of the substrate 1 includes the base surface 11, and the protruding surface 12 protruding in the z direction from the base surface 11. The protruding surface 12 extends along the x direction. The multiple heating portions 31 are formed on the protruding surface 12. Accordingly, the contact area between the recording medium and the thermal print head A10 can be further reduced during the use of the thermal print head A10. Thus, printing quality related to the multiple heating portions 31 on the recording medium can be enhanced.

Moreover, the protruding surface 12 includes: the top surface 121, parallel to the base surface 11 of the substrate 1; and a pair of inclined surfaces 122, connected to the top surface 121 and the base surface 11, and located on positions separate from each other in they direction. The multiple heating portions 31 are formed on the top surface 121. A part of the common wire 41 and a part of each of the multiple independent wires 42 are formed on any one of the pair of inclined surfaces 122. Accordingly, when observed along the z direction, respective sizes of the multiple heating portions 31 in they direction can be further reduced, and the contact area between the recording medium and the thermal print head A10 can be further reduced during the use of the thermal print head A10. Thus, the amount of heat generated by the thermal print head A10 can be suppressed, and printing quality on the recording medium can be further enhanced.

In the substrate 1, the pair of inclined surfaces 122 are inclined relative to the base surface 11 in a way of approaching each other from the base surface 11 toward the top surface 121. In the manufacturing method of the thermal print head A10, the protrusion 17 is formed on the base material 81 by means of anisotropic etching to show the shape of such protruding surface 12. This is because the base material 81 includes a semiconductor material, and the semiconductor material includes a monocrystalline material consisting of silicon.

The thermal print head A10 further includes the heat dissipation plate 72. The back surface 13 of the substrate 1 is joined to the heat dissipation plate 72. Accordingly, during the use of the thermal print head A10, a part of heat energy generated by the multiple heating portions 31 is rapidly released to the exterior through the heat dissipation plate 72 and the substrate 1.

Second Embodiment

On the basis of FIG. 19 to FIG. 20, a thermal print head A20 according to a second embodiment of the disclosure is described below. In the accompanying drawings, elements that are the same as or similar to those of the thermal print head A10 described above are given the same numerals and denotations, and repeated description is omitted. Herein, a cross section position of FIG. 19 is the same as the cross section position of the thermal print head A10 in FIG. 5.

In the thermal print head A20, the structure of the protruding surface 12 of the substrate 1, and the structure of the multiple heating portions 31 of the resistance layer 3 are different from the structures in the thermal print head A10 described above.

Figure 19:
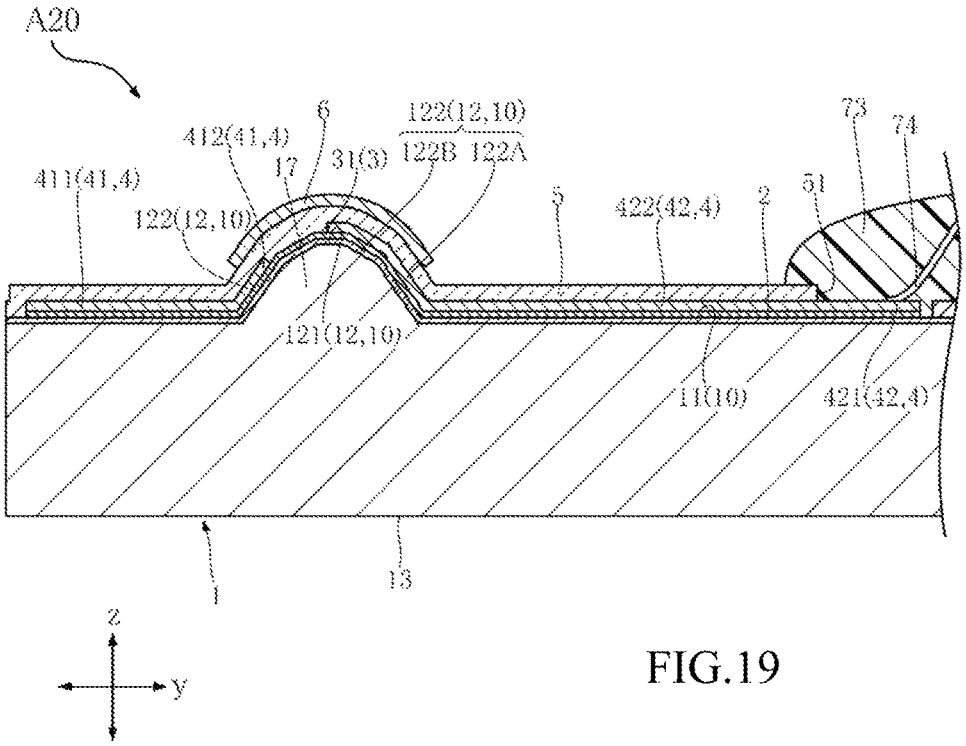
FIG. 19 is a section diagram of the main part of a thermal print head according to a second embodiment of the disclosure.
Figure 20:
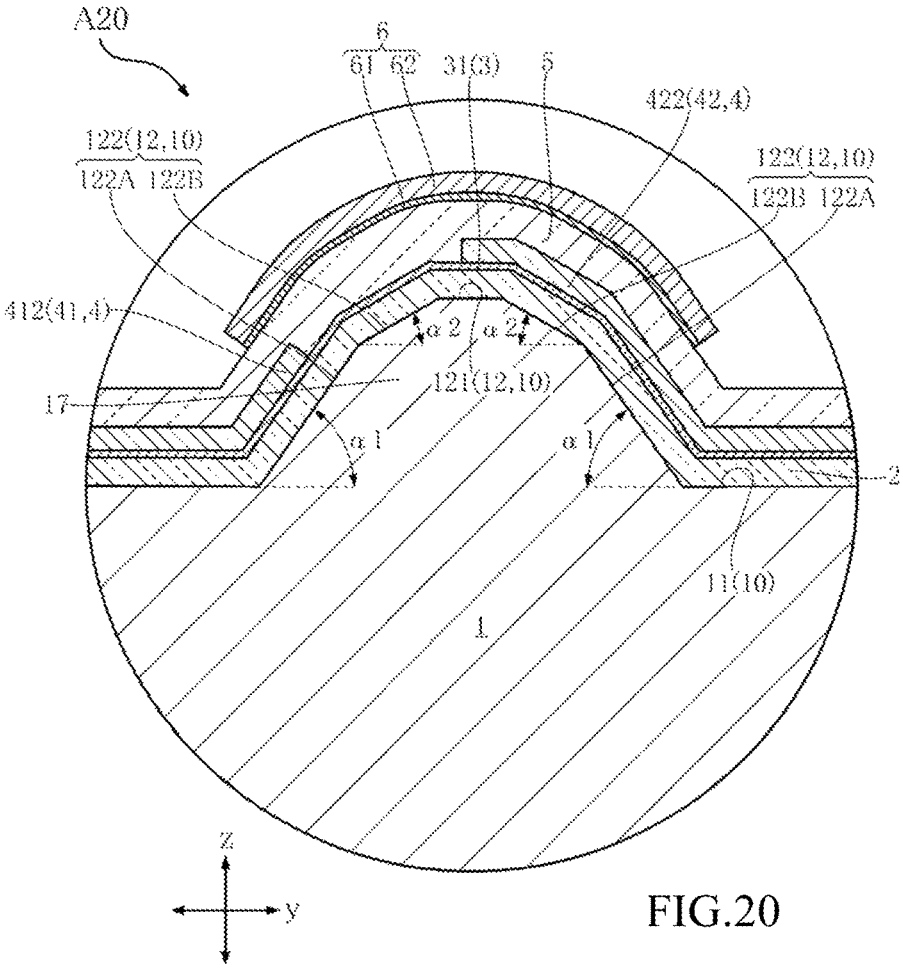
FIG. 20 is an enlarged partial view of FIG. 19.

As shown in FIG. 19 and FIG. 20, each of the pair of inclined surfaces 122 of the protruding surface 12 includes a first region 122A and a second region 122B. The first region 122A is connected to the base surface 11 of the substrate 1. The second region 122B is connected to the top surface 121 of the protruding surface 12 and the first region 122A. An inclined angle $\alpha 2$ of the second region 122B of each of the pair of inclined surfaces 122 relative to the base surface 11 is less than an inclined angle $\alpha 1$ of the first region 122A relative to the base surface 11. Such pair of inclined surfaces 122 are formed by implementing wet etching using tetramethylammonium hydroxide (HMAH) aqueous solution on and near the borders between the top surface 121 and the pair of inclined surfaces 122 between the step shown in FIG. 8 and the step shown in FIG. 9.

As shown in FIG. 20, the multiple heating portions 31 of the resistance layer 3 are formed by the following pattern. First, the multiple heating portions 31 are formed on the top surface 121 of the protruding surface 12. Second, the multiple heating portions 31 are formed in a way of crossing the top surface 121, and the second region 122B of the inclined surface 122 located on the downstream side between the pair of the inclined surface 122 of the protruding surface 12. Third, the multiple heating portions 31 are formed in a way of crossing the top surface 121, the second region 122B of the inclined surface 122 located on the downstream side between the pair of the inclined surface 122, and the first region 122A of the inclined surface 122. Fourth, the multiple heating portions 31 are formed in a way of crossing the second region 122B of the inclined surface 122 located on the downstream side between the pair of the inclined surface 122, and the first region 122A of the inclined surface 122. To sum up the pattern above, the multiple heating portions 31 are formed on at least one of the top surface 121 and the pair of inclined surfaces 122.

Next, effects of the thermal print head A20 are given below.

The thermal print head A20 includes: the protection layer 5, covering a part of the main surface 10 of the substrate 1, the multiple heating portions 31 of the resistance layer 3 and the wiring layer 4; and the coating layer 6, covering at least a part of the protection layer 5. The coating layer 6 overlaps with the multiple heating portions 31 when observed along the z direction. The coating layer 6 has the base layer 61 connected to the protection layer 5, and the body layer 62 overlaying the base layer 61. Each of the base layer 61 and the body layer 62 includes a metal element. As described above, according to the thermal print head A20, low manufacturing efficiency can be suppressed, and wear-resistance of the thermal print head A20 against a recording medium can be enhanced.

In the thermal print head A20, each of the pair of inclined surfaces 122 (the protruding surface 12) of the substrate 1 includes the first region 122A and the second region 122B. The first region 122A is connected to the base surface 11 of the substrate 1. The second region 122B is connected to the top surface 121 of the protruding surface 12 and the first region 122A. The inclined angle $\alpha 2$ of the second region 122B of each of the pair of inclined surfaces 122 relative to the base surface 11 is less than the inclined angle $\alpha 1$ of the first region 122A relative to the base surface 11. Using the structure above, the surface of the protection layer 5 formed along the protruding surface 12 is smoother. Further, because the coating layer 6 conforms to the shape of the surface of the protection layer 5, the surface of the coating layer 6 is also smoother. Thus, during the use of the thermal print head A20, the coefficient of dynamic friction of the recording medium against the coating layer 6 is reduced when the recording medium is in contact with the coating layer 6, and so paper bits caused by the recording medium can be avoided from attaching to the coating layer 6.

The coating layer 6 included in the thermal print head A10 and the thermal print head A20 has the base layer 61 and the body layer 62. Apart from being applied to the thermal print head A10 and the thermal print head A20 manufactured from the base materials 81 respectively including semiconductor materials, the coating layer 6 can also be applied to the following thermal print heads. First, a thick-film thermal print head; in the thermal print head, the multiple hearting portions 31 of the resistance layer 3, the wiring layer 4, and protection layer 5 are formed on an aluminum substrate or a ceramic substrate such as an aluminum nitride (ALN) substrate, or a glass substrate, by using a thick-film technology. The material of the multiple heating portions 31 in this case may be implemented by ruthenium dioxide ($RuO_2$), tantalum silicon oxide ($TaSiO_2$), tantalum nitride (TaN) and tantalum silicon nitride (TaSiN). Second, a thin-film thermal print head; in the thermal print head, the multiple hearting portions 31, the wiring layer 4, and protection layer 5 are formed on the ceramic substrate or the glass substrate by using a thin-film technology. The material of the multiple heating portions 31 in this case may be implemented by tantalum silicon oxide ($TaSiO_2$), tantalum nitride (TaN) and tantalum silicon nitride (TaSiN).

The disclosure is not limited to the embodiments described above. Various design modifications may be made as desired to the specific structures of the components of the disclosure.

What is claimed is:

1. A thermal print head, comprising:

a substrate, having a main surface facing a thickness direction;

a resistance layer, comprising a plurality of heating portions arranged in a main scan direction, and formed on the main surface;

a wiring layer, formed on the resistance layer, and connected to the plurality of heating portions; and a protection layer, covering a part of the main surface, the plurality of heating portions and the wiring layer, wherein the thermal print head comprises:

a coating layer, covering at least a part of the protection layer, wherein the coating layer overlaps with the plurality of heating portions when observed along the thickness direction, and comprises:

a base layer connected to the protection layer; and a body layer overlaying the base layer, wherein each of the base layer and the body layer comprises a metal element, wherein the metal element of the base layer and the metal element of the body layer are bonded by a metallic bond.

2. The thermal print head of claim 1, wherein a Vickers hardness of the body layer is greater than a Vickers hardness of the protection layer.

3. The thermal print head of claim 2, wherein the protection layer comprises silicon.

4. The thermal print head of claim 1, wherein the main surface includes a base surface and a protruding surface that protrudes from the base surface in the thickness direction, wherein the protruding surface extends along the main scan direction and the plurality of heating portions are formed on the protruding surface.

5. The thermal print head of claim 4, wherein the coating layer overlaps with the protruding surface when observed along the thickness direction.

6. The thermal print head of claim 4, wherein the protruding surface includes:

a top surface parallel to the base surface; and a pair of inclined surfaces connected to the top surface and the base surface, and located apart from each other in a secondary scan direction, wherein the plurality of heating portions are formed on at least one of the top surface and the pair of inclined surfaces.

7. The thermal print head of claim 6, wherein the wiring layer comprises a common wire and a plurality of independent wires, wherein the common wire is located on one side of the secondary scan direction relative to the plurality of heating portions, the plurality of independent wires are located on the other side of the secondary scan direction relative to the plurality of heating portions, and a part of the common wire and a part of each of the plurality of independent wires are formed on any one of the pair of inclined surfaces.

8. The thermal print head of claim 7, wherein the pair of inclined surfaces are inclined relative to the base surface in a manner of approaching each other from the base surface toward the top surface.

9. The thermal print head of claim 8, wherein each of the pair of inclined surfaces includes a first region connected to the base surface, and a second region connected to the top surface and the first region, wherein an inclined angle of the second region relative to the base surface is less than an inclined angle of the first region relative to the base surface.

10. The thermal print head of claim 4, wherein the substrate is made of a semiconductor material, and the semiconductor material comprises a monocrystalline material composed of silicon.

11. The thermal print head of claim 1, further comprising an insulation layer covering the main surface, wherein the resistance layer is connected to the insulation layer.

12. The thermal print head of claim 1, further comprising a heat dissipation plate, wherein the substrate has a back surface on one side opposite to the main surface in the thickness direction, and the back surface is joined with the heat dissipation plate.

13. A thermal printer, comprising:

the thermal print head of claim 1; and a pressure plate, arranged oppositely to the plurality of heating portions.

14. The thermal print head of claim 1, wherein the each of the base layer and the body layer consists essentially of the metal element.

15. A method of manufacturing a thermal print head, comprising:

forming a resistance layer on a main surface of a substrate, the main surface facing a thickness direction, wherein the resistance layer includes a plurality of heating portions arranged in a main scan direction on the main surface;

forming a wiring layer connected to the plurality of heating portions on the resistance layer;

forming a protection layer covering a part of the main surface, the plurality of heating portions and the wiring layer; and forming a coating layer covering at least a part of the protective layer, wherein the formation of the coating layer comprises:

forming a base layer comprising metal element and connected to the protection layer; and forming a body layer comprising metal element and overlaying the base layer, wherein the body layer is formed by plating, wherein the metal element of the base layer and the metal element of the body layer are bonded by a metallic bond.

16. The method of claim 15, wherein in the formation of the coating layer, the base layer is formed by sputtering, and the body layer is formed by electroplating using the base layer as a conductive path.

17. The method of claim 15, wherein the main surface includes a base surface and a protruding surface that protrudes from the base surface in the thickness direction, wherein before the formation of the resistance layer, the manufacturing method further comprises forming a protrusion on the base material, the protrusion protruding from the base surface in the thickness direction, extending along the main scan direction, and including the protruding surface, and wherein in the formation of the resistance layer, the plurality of heating portions are formed on the protruding surface.

18. The method of claim 17, wherein the base material is made of a semiconductor material, and the semiconductor material comprises a monocrystalline material composed of silicon.

19. The method of claim 18, wherein the protrusion is formed by anisotropic etching.

* * * * *